US008534960B2

(12) United States Patent
Wong

(10) Patent No.: US 8,534,960 B2
(45) Date of Patent: Sep. 17, 2013

(54) PILING DEVICE

(75) Inventor: Yew Kee Wong, Singapore (SG)

(73) Assignee: YK Equipment PTE Ltd., Singapore (SG)

( * ) Notice: Subject to any disclaimer, the term of this patent is extended or adjusted under 35 U.S.C. 154(b) by 230 days.

(21) Appl. No.: 13/056,204

(22) PCT Filed: Jul. 31, 2008

(86) PCT No.: PCT/SG2008/000284

§ 371 (c)(1),
(2), (4) Date: Jan. 27, 2011

(87) PCT Pub. No.: WO2010/014039

PCT Pub. Date: Feb. 4, 2010

(65) Prior Publication Data

US 2011/0129307 A1 Jun. 2, 2011

(51) Int. Cl.
*E02D 7/00* (2006.01)

(52) U.S. Cl.
USPC ..... 405/232; 173/39; 173/213

(58) Field of Classification Search
USPC ..... 405/229, 231, 232; 173/39, 42, 173/186, 192, 213
See application file for complete search history.

(56) References Cited

U.S. PATENT DOCUMENTS

| | | | | |
|---|---|---|---|---|
| 3,827,508 | A | 8/1974 | MacKinnon | |
| 3,832,858 | A * | 9/1974 | Anders | 405/232 |
| 5,568,997 | A * | 10/1996 | Raunisto | 405/232 |
| 6,386,295 | B1 * | 5/2002 | Suver | 405/232 |
| 6,691,797 | B1 * | 2/2004 | Hart | 405/232 |
| 6,942,430 | B1 * | 9/2005 | Suver | 405/232 |
| 7,407,343 | B2 * | 8/2008 | van Halteren et al. | 405/232 |
| 7,591,612 | B2 * | 9/2009 | Wong | 405/232 |
| 2005/0201836 | A1 * | 9/2005 | Suver | 405/232 |
| 2006/0216118 | A1 * | 9/2006 | Wong | 405/232 |
| 2008/0304917 | A1 * | 12/2008 | van Halteren et al. | 405/232 |
| 2008/0310923 | A1 * | 12/2008 | Jinnings et al. | 405/232 |

FOREIGN PATENT DOCUMENTS

| | | | |
|---|---|---|---|
| DE | 3615596 | A1 | 11/1987 |
| EP | 0103283 | B1 | 7/1988 |
| GB | 747338 | A | 4/1956 |
| GB | 2367322 | A | 4/2002 |
| WO | 2004042152 | A1 | 5/2004 |

OTHER PUBLICATIONS

PCT International Search Report, International Application No. PCT/SG2008/000284, mailed Nov. 7, 2008, six (6) pages.

PCT International Preliminary Report on Patentability, International Application No. PCT/SG2008/000284, mailed Feb. 8, 2010, four (4) pages.

* cited by examiner

*Primary Examiner* — Frederick L Lagman
(74) *Attorney, Agent, or Firm* — TraskBritt

(57) ABSTRACT

A piling device including a support frame, a pile-gripping mechanism for gripping a pile and a pile-driving mechanism for driving the pile into the ground. The pile-gripping mechanism and the pile-driving mechanism are connected to and supported by the frame. The piling device also includes a rotation assembly to facilitate rotation of the support frame relative to a rotation footing about a rotation axis.

23 Claims, 3 Drawing Sheets

PILING DEVICE

CROSS-REFERENCE TO RELATED APPLICATION

This is a national phase entry under 35 U.S.C. §371 of International Patent Application PCT/SG2008/000284, filed Jul. 31, 2008, published in English as International Patent Publication WO 2010/014039 A1 on Feb. 4, 2010, the entire disclosure of which is hereby incorporated herein by this reference.

FIELD

The present invention relates generally to the construction and building industries and, in particular, to constructing foundations. The invention specifically relates to a device for driving piles, and will hereinafter be described in that context. Nevertheless, it is to be understood that the invention need not be limited to that specific use and may instead have a broader application to that described herein.

BACKGROUND

The driving of reinforced concrete and H-beam piles is of fundamental importance in an array of construction and building applications. Various pile-driving techniques exist involving the use of a range of pile-driving devices.

One form of existing pile-driving devices is the hammer piling device. Hammer piling devices include a hammer, which is used to repeatedly free-fall on the upper end of a pile to drive it into the ground. The hammer is mounted in an upstanding steel frame and is lifted within the frame using a hydraulic lifting assembly. The steel frame may be mounted directly on the ground at a location in which it is desired to hammer a pile. Alternatively, the steel frame may be mounted on the tray of a truck in order to provide mobility to the device. Advantageously, hammer piling devices are relatively cost effective to manufacture and use and, if mobile, relatively easily movable between piling sites. One major disadvantage of hammer piling devices is that repeated impact of the hammer on the upper end of the pile is very noisy. Indeed, the repeated hammer impact on the pile can generate ground vibration that is not only unpleasant, but can lead to structural damage of surrounding buildings and other structures.

Another option exists in the form of hole boring devices. Rather than hammering a pile into the ground, a hole can be bored into the ground to the required depth, following which a pile is placed into the hole. Hole-boring devices incorporate a downwardly directed rotating bore rotatably mounted within a steel support frame. The bore is rotated by a suitably configured rotating mechanism. The frame may be mounted directly on the ground at a location in which it is desired to bore a hole. Alternatively, the frame, rotating bore and rotating mechanism may be mounted on a truck tray in order to provide a mobile arrangement.

Boring devices provide the benefit of generating less noise and unpleasant and potentially damaging vibrations in the area surrounding the boring site. Boring devices are also effective for use in large-scale piling operations. Disadvantages of using boring devices include the fact that they have generally higher operating costs when compared to hammer piling devices. It is also more time consuming to bore a hole than hammer a pile. A dedicated area must also be temporarily provided in the vicinity for placing soil to be used in backfilling a pile hole. This can be inconvenient on cramped sites.

It is possible to use a boring device in conjunction with a hammer piling device. In this regard, a hole may be initially partially pre-bored using a boring device. A pile may then be inserted into the partially pre-bored hole and a hammer piling device then used to hammer the pile to the desired depth. Partially pre-boring the hole advantageously reduces the amount of vibration generated when compared to using a hammer piling device for the entire process. However, drawbacks do exist in partially pre-boring a hole, including increases in time and cost. Further, partial pre-boring is generally only useful in applications of limited capacity.

Hence, each of the above-described techniques has associated shortcomings.

Hydraulic piling devices (often referred to as "silent piling devices") have been developed in an attempt to address at least some of these shortcomings. The general configuration of hydraulic piling devices is to include an upstanding support frame, with one or more hydraulic jacking cylinders connected to and extending downwardly within the frame. An arrangement for engaging an upper end of a pile is generally connected to a lower end of the jacking cylinders. Alternatively, the arrangement for engaging an upper end of a pile is replaced with a gripping arrangement for gripping around the pile. The gripping arrangement would typically also be connected to a lower end of the jacking cylinders.

In such an arrangement, extension of the hydraulic cylinders causes the pile to be forced (or pushed) into the ground. Counterweights are typically provided on the support frame to ensure that extension of the hydraulic cylinders forces the pile into the ground, rather than causing the hydraulic piling device to lift upwardly from the ground.

One advantage of hydraulic piling devices is that they generate far less noise and ground vibration when compared to hammer piling devices.

Disadvantages of many existing hydraulic piling devices include the relatively time-consuming process of moving those devices from one piling site to another piling site. This is exacerbated by the design of these devices, which require counterweights to be unloaded from the device before the device can be moved. The counterweights then have to be reloaded onto the device before it can be used to drive a pile at the next site.

The time-consuming process of moving many existing hydraulic piling devices is also undesirable in instances where a large object such as a rock is encountered during the piling process. A partially driven pile can undesirably create an extended downtime, as it is usually necessary to first break off the portion of the pile extending from the ground before going through the process of moving the piling device to another location.

The support frames of many existing hydraulic devices have a height approximating twice the pile length. This height can result in an inherently unstable device, which must be taken into consideration when moving, installing and operating the device.

A still further problem of many existing hydraulic piling devices is the fact that they are not adequately designed for operating on sloping or uneven ground.

Yet another problem with existing hydraulic piling devices is that it is not generally possible to drive a pile adjacent an existing object, such as wall, building or other structure, given that the support frames of existing devices are configured to surround the pile being driven into the ground. Thus, a space sufficient to temporarily accommodate the frame must be provided between the existing object and position of the pile-driving site.

The inventor has addressed a number of the aforementioned problems of many existing piling devices by designing a hydraulic piling device, the subject of International Patent Application No. PCT/SG2003/000177 (WO 2004/042152), the entire contents and disclosure of which is incorporated herein by reference. That device addresses the inherent instability of earlier hydraulic piling devices by providing a wider and more stable footing for support of the frame, hydraulic jacking cylinders and gripping arrangement when compared to that of existing hydraulic piling devices. The device also provides maneuverability of the frame, hydraulic jacking cylinders and gripping arrangement by providing frame-mounted footings that are movable relative to respective ground-mounted footings. This arrangement also provides for the movement of the device irrespective of whether counterweights are mounted thereon, thereby avoiding the need to unload the counterweights before moving the device.

Further, the device allows for the removal thereof from around a pile partially extending from the ground. This is possible because of the provision of openings provided in the opposing sides of the frame. The device can also be effectively used on sloping or uneven ground by the vertical adjustment of the frame-mounted footings relative to the respective ground-mounted footings.

The inventor's hydraulic piling device, the subject of International Patent Application No. PCT/SG2003/000177, has, therefore, provided considerable advances in piling devices generally and hydraulic piling devices in particular.

Nevertheless, it would be desirable to further improve the stability of existing hydraulic piling devices.

It would also be desirable to further improve the maneuverability of existing hydraulic piling devices.

It would be still further desirable to provide an arrangement enabling the driving of a pile adjacent or at least close to an existing object or structure.

BRIEF SUMMARY

According to one broad aspect of the present invention, there is provided a piling device. The device includes a support frame, a pile-gripping mechanism for gripping a pile and a pile-driving mechanism for driving the pile into the ground. The pile-gripping mechanism and the pile-driving mechanism are connected to and supported by the support frame. The device also includes a rotation assembly to facilitate rotation of the support frame relative to a rotation footing about a rotation axis.

Such an arrangement may enable the frame, pile-gripping mechanism and pile-driving mechanism to be rotated and subsequently maneuvered in a desired direction away from a pile extending partially from the ground.

In one particularly preferred form, the support frame includes a lower support frame portion, with an upstanding support frame portion mounted thereon, and with the pile-gripping mechanism and pile-driving mechanism connected to the upstanding support frame portion.

It is to be appreciated that rotation of the support frame relative to the rotation footing (and, hence, also rotation of the pile-gripping mechanism and pile-driving mechanism relative to the rotation footing) occurs in a generally horizontal plane, but that this will be at least partially dependent on the evenness and slope of the underlying ground.

The piling device may include a first set of ground-mounted footings and respective first set of frame-mounted footings, and a second set of ground-mounted footings and respective second set of frame-mounted footings. In one arrangement, the first set of ground-mounted footings and frame-mounted footings are disposed generally at one end of the piling device, and the second set of ground-mounted footings and frame-mounted footings are disposed generally at an opposite end of the piling device. The rotation footing is generally centrally located between the first set of ground- and frame-mounted footings and the second set of ground- and frame-mounted footings.

In one preferred form, the rotation footing is generally circular.

The rotation assembly may include at least one hydraulic motor to facilitate rotation of the support frame relative to the rotation footing. More preferably, however, the rotation assembly includes at least one pair of hydraulic motors, mounted on the rotation assembly on generally opposite sides of the rotation axis.

Any suitable arrangement may be provided to allow the frame to rotate upon and relative to the rotation footing.

The piling device preferably includes counterweights mounted on the support frame to prevent the frame moving during the piling operation. More specifically, the counterweights are provided to prevent the frame from lifting during the piling process. The counterweights may rest on horizontal support surfaces provided on opposite sides of the lower support frame portion. The counterweights may be releasably secured to the lower support frame portion.

Preferably, the rotation assembly is configured to also facilitate rotation of the counterweights relative to the rotation footing about the rotation axis. In this way, the counterweights need not be unloaded from the support frame prior to rotation of the frame about the rotation footing.

The rotation assembly may be operated via a control panel.

According to another broad aspect of the invention, there is provided a piling device. In this aspect, the device includes a support frame having a lower end mounted on a footing, a pile-gripping mechanism for gripping a pile, and a pile-driving mechanism for driving the pile into the ground. The pile-gripping mechanism and the pile-driving mechanism are connected to and supported by the support frame in a position generally proximate an outer side surface of the support frame.

In one particularly preferred form, the piling device includes a support frame having a lower support frame portion with an upstanding support frame portion mounted thereon. In this arrangement, the pile-gripping mechanism and the pile-driving mechanism are connected in a position generally proximate an outer side surface of the upstanding support frame portion.

In this way, the piling device may be used to drive a pile adjacent to or proximate another object, such as a wall, building or other structure.

The pile-gripping mechanism and pile-driving mechanism may be connected to a connection member, with the connection member connected to the outer side surface of the support frame (in particular, to an outer side surface of the upstanding support frame portion).

The pile-driving mechanism and the pile-gripping mechanism may include separate, but connected frames.

In one preferred form, the connection member is adjustably connected to the upstanding support frame portion, enabling a pile gripped by the pile-gripping mechanism to be moved relative to the upstanding support frame portion prior to being driven into the ground. Adjustment of the connection member relative to the upstanding support frame portion may be by way of a hydraulically operated actuator operated from a control panel, or by any other suitable means.

A pivotal displacement member in the form of an arm or pin may be provided to pivotally displace the pile-gripping mechanism and pile-driving mechanism relative to the connection member. In this way, a pile gripped by the pile-gripping mechanism can be aligned in a desired orientation to the frame and ground. The actuating arm or pin may be mounted at any suitable location. For example, the actuating arm or pin may be mounted to the connection member for contact with the pile-driving mechanism (or frame thereof) to pivotally adjust the pile-gripping mechanism and pile-driving mechanism relative to the connection member. In another possible arrangement, the actuating arm or pin may be mounted to the driving frame for contact with the connection member to pivotally adjust the pile-gripping mechanism and the pile-driving mechanism relative to the connection member.

The actuating arm or pin may include a screw-threaded arrangement.

The previously referred to outer side surface would typically be provided on an outer side of the support frame. In such an arrangement, the support frame preferably has an opposing outer side. Moreover, the piling device preferably includes a side support frame connected to the opposing outer side of the support frame. The side support frame may include a side support frame footing, with the side support frame footing being movable in a generally vertical direction relative to the side support frame.

The side support frame is provided to further stabilize the support frame during the driving of a pile and to assist in preventing lift of the support frame during the pile-driving process.

The piling device may include at least one hydraulic cylinder connected to and extending between the side support frame and the side support frame footing to facilitate generally vertical movement of the side support frame footing relative to the side support frame. In this way, the footing of the side support frame may be raised from the ground during operation of the rotation assembly. The footing may also be vertically adjusted to take into account uneven and/or sloping ground.

The piling device may include a hydraulically actuated crane or winch assembly for maneuvering a pile into a gripping position. Each of the pile-gripping mechanism and the pile-driving mechanism may include a side opening to readily allow a pile to be maneuvered by the crane or winch into the gripping position.

Both the hydraulic cylinder connected to and between the side frame and its associated footing and the hydraulically actuated crane or winch may be operated via a control panel.

In a preferred form, the support frame includes at least one pair of counterweight supports (and preferably two counterweight supports), with each counterweight support having a counterweight support surface for mounting counterweights thereon. Each counterweight support is preferably movable in a generally horizontal plane relative to the support frame between a piling position and a non-piling position.

It is to be appreciated that the non-piling position would generally correspond to each counterweight support (with counterweights mounted thereon) located directly above the lower support frame portion, and the piling position would generally correspond to at least a portion of each counterweight support (with counterweights mounted thereon) extending outwardly beyond the side of the support frame to the side of the pile-gripping mechanism and pile-driving mechanism. Such an arrangement is particularly desirable because it enables the counterweights to be more closely located about the pile-gripping and pile-driving mechanisms to resist lifting of the support frame during the piling process.

Movement of each counterweight support between the piling and non-piling positions may be by any suitable means. In one form, at least one generally horizontally disposed hydraulic cylinder is provided to facilitate movement of the counterweight supports between the piling and non-piling positions. Such an arrangement preferably also includes a roller assembly mounted between the support frame and the ground-mounted footing.

Preferably, at least one generally vertically disposed hydraulic cylinder is connected to and extends between the frame-mounted footing frame and the lower support frame portion for facilitating vertical displacement of the counterweight supports relative to the support frame. In a particularly preferred arrangement, a plurality of independently operable generally vertically disposed hydraulic cylinders are provided. This is desirable in order to counter any sinking into the ground that the frame (or at least one side of the frame) may experience when the counterweight supports are moved from the non-piling position to the piling position.

According to a further broad aspect, there is provided a piling device. In this aspect, the device includes a support frame having a lower end mounted on a footing, a pile-gripping mechanism for gripping a pile, and a pile-driving mechanism for driving the pile into the ground. The pile-gripping mechanism and the pile-driving mechanism are connected to and supported by the support frame. The piling device has a height, a width and a depth. The height is generally defined as extending between a lowermost portion of the device and an uppermost portion of the support frame. The width is generally defined as extending between a first outer edge of the footing and a second outer edge of the footing. The width is a larger dimension than the depth, and the ratio of the width to the height is at least 1.5:1.0.

This ratio of device width to device height is considered unique by the inventor, and is also considered to provide a fundamentally more stable piling device than existing hydraulic piling devices known to the inventor. As far as the inventor is aware, no one has previously been able to design a hydraulic piling device with these dimension ratios and, therefore, such an inherently stable device has not previously been possible.

More preferably, the ratio of the width of the device to the device height is at least 2.0:1.0. Still more preferably, the ratio of the device width to the device height is at least 2.3:1.0.

It is to be generally understood that the support frame may have a lower support frame portion, with an upper support frame portion mounted thereon. In such an arrangement, it is to be understood that the height may extend between a lowermost portion of the device and uppermost portion of the upper support frame portion.

More than one aspect of the invention has been described above. It is to be appreciated that these aspects can be considered separately or in combination.

It will now be convenient to hereinafter describe a preferred embodiment of the invention with reference to the accompanying drawings. The particularity of the drawings is to be understood as not limiting the preceding broad description of the invention.

DETAILED DESCRIPTION

Figure 1:
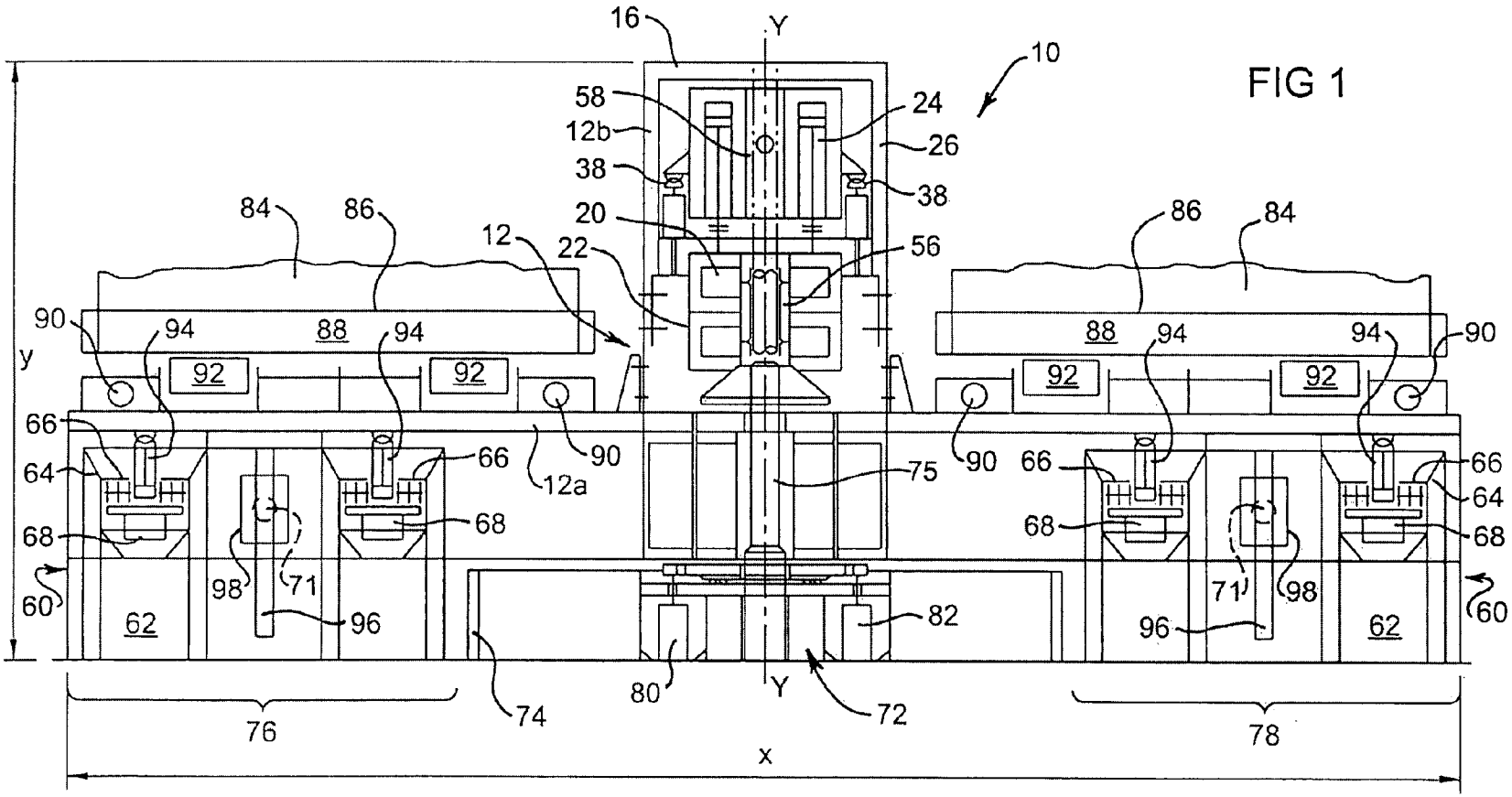
FIG. 1 illustrates in diagrammatic form a front view of one embodiment of a piling device according to the present invention.

Referring to the drawings, there is illustrated a hydraulic pile-driving device 10. The pile-driving device 10 is configured for driving reinforced concrete and H-beam piles into the ground.

Figure 2:
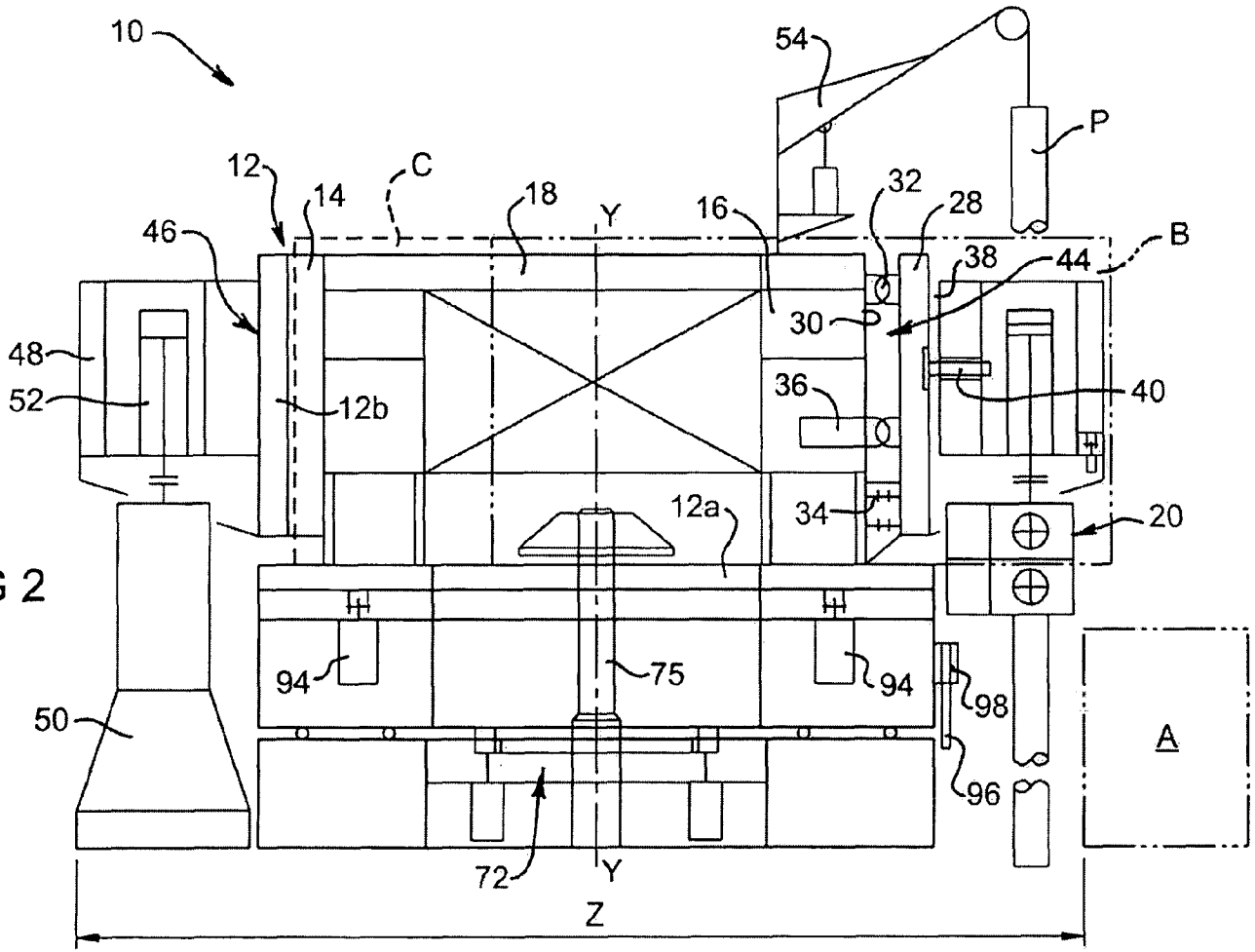
FIG. 2 is a side view of the piling device of FIG. 1.

With reference to FIGS. 1 and 2, the pile-driving device 10 includes a steel support frame 12. The support frame 12 includes a lower support frame portion 12*a*, with an upper support frame portion 12*b* mounted thereon. The upper support frame portion 12*b* includes upstanding beams 14, 16 connected together using cross-beams 18 (see FIG. 2).

A pile-gripping mechanism 20 for gripping a pile P is provided. The pile-gripping mechanism 20 includes a gripping frame 22, which houses powerful hydraulic cylinders (not clearly visible). The hydraulic cylinders are provided to actuate pile-engaging clamps (again, not clearly visible) provided within the pile-gripping mechanism 20. The clamps are designed to grip about the circumference of the pile P.

A pile-driving mechanism 24 for driving the pile P in a downward direction into the ground is also provided. The pile-driving mechanism 24 includes a driving frame 26. The gripping frame 22 is connected to and suspended beneath the driving frame 26.

Referring to FIG. 2, pile-gripping mechanism 20 and the pile-driving mechanism 24 are connected to a connection member 28. The connection member 28 is connected to an outer side surface 30 of the upper support frame portion 12*b* of support frame 12. In this way, the pile-driving device 10 may be used to drive a pile P adjacent to or proximate another object A (illustrated in dashed line format), such as a building, wall or other structure. This is difficult, if not impossible, to accomplish with existing hydraulic piling devices known to the inventor.

The connection member 28 is pivotally connected to the upper support frame portion 12*b* by pivot mounts 32. The connection member 28 may be secured in a desired pivotal orientation to the upper support frame portion 12*b* via an adjustment bracket 34.

A pivotal displacement member 36 in the form of a hydraulic actuator is provided. The pivotal displacement member 36 facilitates pivotal displacement of the connection member 28 (and thus also the pile-gripping mechanism 20 and pile-driving mechanism 24 (see FIG. 1)) relative to the upper support frame portion 12*b*, when required, about the pivot mounts 32.

The displacement member 36 is operated via a control panel (not illustrated).

Further, pivot mounts 38 are provided, connecting the pile-driving mechanism 24 (FIG. 1) to the upper end of the connection member 28. A further pivotal displacement member in the form of a threaded arm or pin 40 is provided for retaining the pile-gripping mechanism 20 and pile-driving mechanism 24 in a desired pivotal orientation about the pivot mounts 38 relative to the connection member 28.

As can be seen from the drawings, the outer side surface 30 is provided on one side 44 of the upper support frame portion 12*b*. The support frame 12 has an opposing side 46 disposed on the support frame 12 generally opposite to the side 44.

The pile-driving device 10 includes a side support frame 48 connected to the opposing outer side 46 of the support frame 12. The side support frame 48 includes a side support frame footing 50. The side support frame footing 50 is movable in a generally vertical direction relative to the side support frame 48, such that it can be raised from the ground, should it be necessary to move or rotate the pile-driving device 10. Movement of the side support frame footing 50 is controlled by way of a control panel.

The side support frame 48 is provided to further stabilize the support frame 12 during the driving of a pile P. In this regard, the side support frame 48 assists in preventing lift of the support frame 12 from the ground during the pile-driving process.

One or more hydraulic cylinders 52 are connected to and extend between the side support frame 48 and the side support frame footing 50, to facilitate movement of the side support frame footing 50 relative to the side support frame 48.

The pile-driving device 10 includes a hydraulically actuated crane or winch assembly 54 for maneuvering a pile P into a gripping position. The crane or winch assembly 54 is mounted on the upper support frame portion 12*b*. The pile-gripping mechanism 20 and pile-driving mechanism 24 include aligned side openings 56, 58 (FIG. 1) to facilitate maneuvering of the pile P into a gripping position using the crane or winch assembly 54.

The crane or winch assembly 54 may be at least partially operated by way of a control panel.

Referring to FIG. 1, the lower support frame portion 12*a* is mounted on a footing 60. The footing 60 includes ground-mounted footings 62 and corresponding frame-mounted footings 64. Each of the ground-mounted footings 62 includes a channel 66. Each channel 66 accommodates a frame-mounted footing 64. Each pair of ground-mounted footings 62 and frame-mounted footings 64 are separated by roller bearings 68.

Suitably orientated, horizontally extending hydraulic cylinders 71 (not clearly visible) are connected between the lower support frame portion 12*a* and the ground-mounted footings 62 for moving the pile-driving device 10 in the forward and reverse directions. Similarly, suitably orientated, horizontally extending hydraulic cylinders 71 are mounted to ground-mounted footings 62. These cylinders are operable via a control panel.

The pile-driving device 10 also includes a rotation assembly 72 to facilitate rotation about a rotation axis YY of the support frame 12 relative to a circular rotation footing 74.

Such an arrangement desirably enables the support frame 12, the pile-gripping mechanism 20 and the pile-driving mechanism 24 to be rotated and subsequently maneuvered in a desired direction away from a pile that remains extending partially from the ground.

It is to be appreciated that rotation of the support frame 12 and, hence, also the pile-gripping mechanism 20 and pile-driving mechanism 24 relative to the rotation footing 74, occurs in a generally horizontal plane, but that this will be at least partially dependent on the evenness and slope of the underlying ground. Rotation of the support frame 12 occurs about a vertically extending shaft 75 mounted to the rotation footing 74. The shaft 75 provides stability and balance to the pile-driving device 10 during the rotation process.

The rotation assembly 72 includes an arrangement for rotating the support frame 12 thereon. The rotation assembly 72 includes a large gear wheel, pinion gears and rotation sliding rings (these are not clearly visible). The lower support frame portion 12*a* is mounted on or to the upper surface of the gear wheel, and the pinion gears are mounted to rotation footing 74. The rotation sliding rings are suitably located between the rotation footing 74 and the lower support frame portion 12*a* to facilitate rotation therebetween.

With continued reference to FIG. 1, the ground-mounted footings 62 and corresponding frame-mounted footings 64 can be generally regarded as being divided into a first set of ground- and frame-mounted footings 76 (provided at the left-hand end of FIG. 1), and a second set of ground- and frame-mounted footings 78 (provided at the right-hand end of FIG. 1). It can be seen that the rotation assembly 72 (including rotation footing 74) is generally centrally located between the two sets of footings 76, 78.

A pair of hydraulic motors 80, 82 is provided to facilitate rotation of the support frame 12 relative to the rotation footing 74. The arrangement of the motors is balanced, such that they are oppositely disposed about the rotation axis YY. The motors are operated by way of a control panel.

The pile-driving device 10 includes counterweights 84 mounted on the lower support frame portion 12*a* to prevent the support frame 12 moving during the piling operation. More particularly, the counterweights 84 are provided to prevent the support frame 12 from lifting during the piling process. The counterweights 84 rest on horizontal counterweight support surfaces 86 of counterweight supports 88. The counterweight supports 88 are provided on opposite sides of the lower support frame portion 12*a*. The counterweights 84 are releasably secured to the counterweight supports 88.

It is to be appreciated that the rotation assembly 72 is configured to also facilitate rotation of the counterweights 84 relative to the rotation footing 74 about the rotation axis YY. In this way, the counterweights 84 need not be unloaded from the lower support frame portion 12*a* prior to rotation of the support frame 12 about the rotation footing 74.

Figure 3:
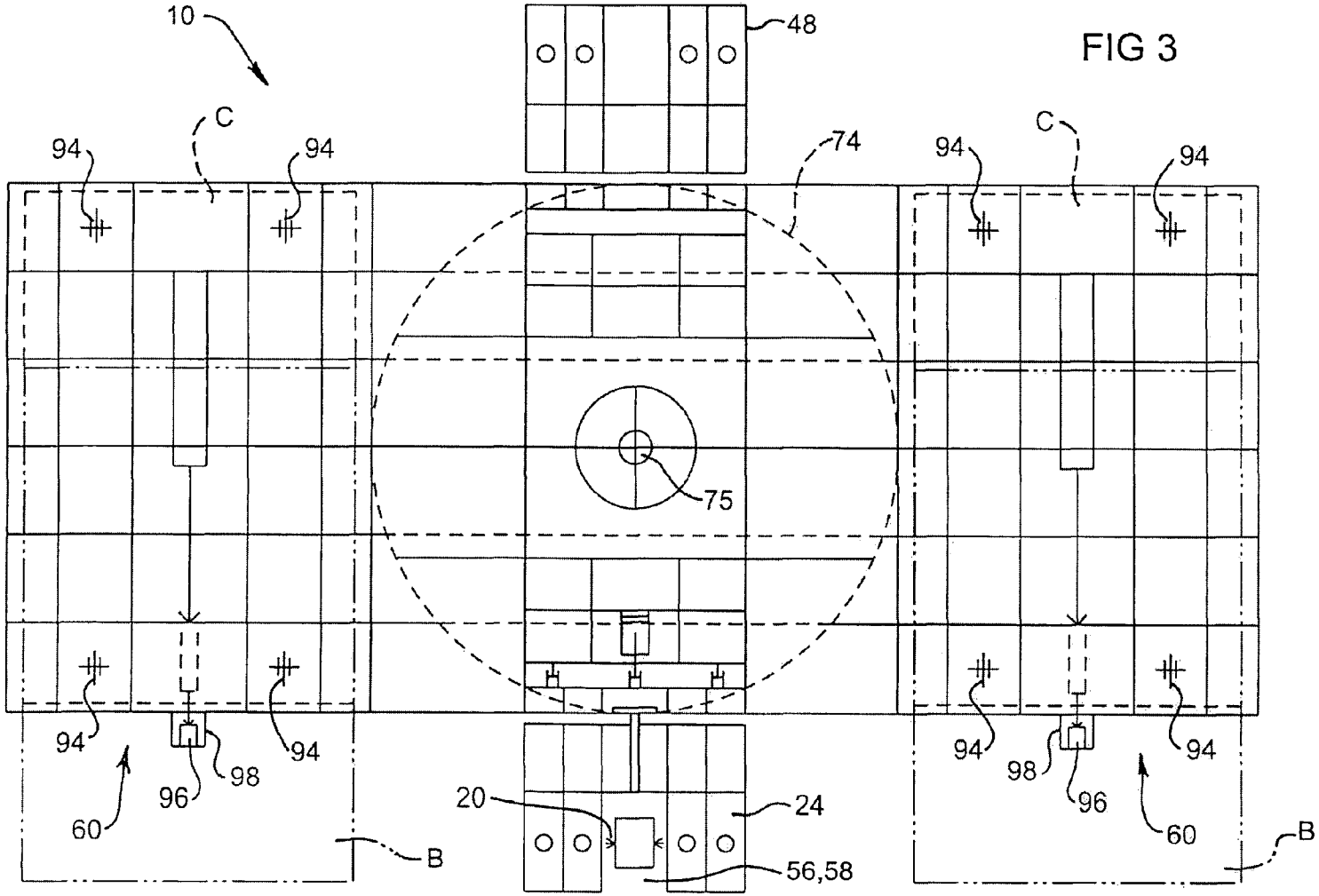
FIG. 3 is a plan view of the piling device of FIG. 1.

The counterweight supports 88 are movable in a generally horizontal plane relative to the lower support frame portion 12*a* between a piling position (B in FIG. 3) and a non-piling position (C in FIG. 3). The non-piling position C generally corresponds to the counterweight supports 88 (with counterweights 84 mounted thereon) located directly above the lower support frame portion 12*a*, and the piling position B generally corresponds to a portion of the counterweight supports 88 (with counterweights 84 mounted thereon) extending outwardly beyond the side of the lower support frame portion 12*a* on either side of the pile-gripping and pile-driving mechanisms 20, 24. Such an arrangement is particularly desirable because it enables the counterweights 84 to be more closely located about the pile-gripping and pile-driving mechanisms 20, 24 to further resist lifting of the support frame 12 during the piling process.

Movement of the counterweight supports 88 between the piling position B and the non-piling position C is possible by virtue of generally horizontally disposed hydraulic cylinders 90 (FIG. 1). The cylinders 90 are connected to and extend between the lower support frame portion 12*a* and the counterweight supports 88 to facilitate movement of the counterweight supports 88 between the piling and non-piling positions B and C. A roller assembly (including rollers 92) is mounted between the lower support frame portion 12*a* and the counterweight supports 88.

A plurality of generally vertically disposed hydraulic cylinders 94 are mounted in the frame-mounted footings 64 (FIG. 1). The upper end of each cylinder 94 is pivotally connected to the lower support frame 12*a*. The cylinders 94 are independently operable by the control panel so as to counter any sinking into the ground that the support frame 12 (or at least one side of the support frame) may experience when the counterweight supports 88 are moved from the non-piling position C to the piling position B.

Vertically extending sliding guides 96 are mounted to the lower support frame portion 12*a*. The sliding guides 96 are slidably received in sliding guide holders 98, which are mounted to the rod end of horizontally extending hydraulic cylinders 71 (FIG. 1). The sliding guides 96 are movable in an upward and downward direction within the sliding guide holders 98.

When the vertical cylinders 94 are activated, the action presses the ground-mounted footings 62 downward (pressing on the ground), and the other end of the vertical cylinder 94 lifts the lower support frame 12*a* and sliding guide 96 and the rotation footing 74 clear of the underlying ground.

Following this, the cylinders 71 connected to the sliding guide holders 98 can be used to push the lower support frame portion 12*a* forward along the roller bearings 68 (mounted on the ground-mounted footing 62) for moving the device 10.

When the vertical cylinders 94 are activated, it is to pull the lower support frame portion 12*a*, sliding guide 96 and rotation assembly 72 downward so as to press on the ground. The other end of each cylinder 94 is used to pull the ground-mounted footing 62 clear of the underlying ground.

Following this, the cylinders 71 (connected to the sliding guide holder 98) are used to pull the lower support frame 12*a* forward along the channels 66 for moving the pile-driving device 10. The channels 66 include rollers mounted therein for engagement with flanged rolling plates provided on the frame-mounted footing 64.

The pile-driving device 10 can generally be regarded as having a height y, a width x and a depth z. Referring to the figures, the height y is generally defined as extending between a lowermost portion of the pile-driving device 10 and an uppermost portion of the upper support frame portion 12*b*. The width x is generally defined as extending between a first outer edge of the footing 60 and a second outer edge of the footing 60. The width is a larger dimension than the depth, and the ratio of the width to the height is at least 1.5:1.0. This ratio of device width to device height is considered unique by the inventor, and is also considered to provide a fundamentally more stable pile-driving device 10 than existing hydraulic piling devices known to the inventor. As far as the inventor is aware, no one has previously been able to design a hydraulic piling device with these dimension ratios and, therefore, such an inherently stable device. While the aforementioned ratio is at least 1.5:1.0, more preferably it is at least 2.0:1.0, and still more preferably it is at least 2.3:1.0. It is to be appreciated that the higher the ratio, desirably the greater the inherent stability of the pile-driving device 10.

Finally, it is to be understood that various alterations, modifications and/or additions may be introduced into the construction and arrangement of the parts previously described without departing from the spirit or ambit of this invention.

The invention claimed is:

1. A piling device, including:

a support frame;

a pile-gripping mechanism for gripping a pile;

a pile-driving mechanism for driving the pile into the ground;

the pile-gripping mechanism and the pile-driving mechanism being connected to and supported by the support frame; and a rotation assembly to facilitate rotation of the support frame relative to a rotation footing about a rotation axis;

the rotation being in a generally horizontal plane.

2. The piling device according to claim 1, wherein the rotation assembly includes gearing mounted between the rotation footing and the support frame to facilitate rotation of the support frame relative to the rotation footing.

3. The piling device according to claim 1, wherein the piling device includes:

a first set of ground-mounted footings and respective first set of frame-mounted footings; and a second set of ground-mounted footings and respective second set of frame-mounted footings;

with the first set of ground-mounted footings and frame-mounted footings disposed generally at one end of the piling device; and the second set of ground-mounted footings and frame-mounted footings disposed generally at an opposite end of the piling device;

wherein the rotation footing is located generally between the first set of ground- and frame-mounted footings, and the second set of ground- and frame-mounted footings.

4. The piling device according to claim 1, wherein the rotation footing is generally circular.

5. The piling device according to claim 1, wherein the rotation assembly includes at least one hydraulic motor to facilitate rotation of the support frame relative to the rotation footing.

6. The piling device according to claim 5, wherein the rotation assembly includes at least one pair of hydraulic motors, with the motors being mounted to the support frame or the rotation footing on generally opposite sides of the rotation axis.

7. The piling device according to claim 1, including counterweights mounted on the support frame to prevent the support frame moving during a piling operation, wherein the rotation assembly is configured to facilitate rotation of the counterweights relative to the rotation footing about the rotation axis.

8. The piling device according to claim 1, wherein the pile-gripping mechanism and the pile-driving mechanism are connected to and supported by the support frame in a position generally proximate an outer side surface of the support frame.

9. The piling device according to claim 8, wherein the pile-gripping mechanism and the pile-driving mechanism are connected to a connection member, the connection member being connected to the outer side surface of the support frame.

10. The piling device according to claim 9, wherein the connection member is pivotably connected to the support frame, enabling a pile gripped by the pile-gripping mechanism to be pivoted relative to the support frame prior to being driven into the ground.

11. The piling device according to claim 10, including a pivotal displacement member for pivotally displacing the connection member relative to the support frame.

12. The piling device according to claim 11, wherein the pivotal displacement member includes an actuator mounted to the connection member or the support frame.

13. The piling device according to claim 8, wherein:

the outer side surface is provided on an outer side of the support frame;

the support frame has an opposing outer side disposed on the support frame generally opposite the outer side;

the piling device includes a side support frame connected to the opposing outer side of the support frame;

the side support frame includes a side support frame footing; and the side support frame footing is movable in a generally vertical direction relative to the side support frame.

14. The piling device according to claim 13, including at least one hydraulic cylinder connected to and extending between the side support frame and the side support frame footing to facilitate movement of the side support frame footing relative to the side support frame.

15. The piling device according to claim 8, including a hydraulically actuated crane or winch assembly for maneuvering the pile into a gripping position.

16. The piling device according to claim 8, wherein each of the pile-gripping mechanism and the pile-driving mechanism includes a side opening to facilitate maneuvering of the pile into a gripping position.

17. The piling device according to claim 8, the support frame including at least one pair of counterweight supports, each counterweight support having a counterweight support surface for mounting counterweights thereon, and each counterweight support being movable in a generally horizontal plane relative to the support frame between a piling position and a non-piling position.

18. The piling device according to claim 17, including at least one generally horizontally disposed hydraulic cylinder connected to and extending between the support frame and each counterweight support to facilitate movement of the counterweight support between the piling and non-piling positions.

19. The piling device according to claim 18, including a roller assembly mounted between the support frame and each counterweight support.

20. The piling device according to claim 17, including at least one generally vertically disposed hydraulic cylinder connected to and extending between a frame-mounted footing and the support frame for facilitating vertical displacement of the support frame relative to the frame-mounted footing.

21. The piling device according to claim 1, in which:

the support frame has a lower end mounted on a footing; and the piling device has a height, a width and a depth;

wherein the height is generally defined as extending between an underside of the footing and an uppermost portion of the support frame;

the width is generally defined as extending between a first outer edge of the footing and a second outer edge of the footing; and the width is a larger dimension than the depth;

with the ratio of the width to the height being at least 1.5:1.0.

22. The piling device according to claim 21, wherein the ratio of the width to the height is at least 2.0:1.0.

23. The piling device according to claim 22, wherein the ratio of the width to the height is at least 2.3:1.0.

* * * * *